US006588629B1

(12) United States Patent
De Pous

(10) Patent No.: US 6,588,629 B1
(45) Date of Patent: Jul. 8, 2003

(54) DISPENSER FITTED WITH AN OUTER FRAME

(75) Inventor: Olivier De Pous, Paris (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 09/979,118

(22) PCT Filed: May 17, 2000

(86) PCT No.: PCT/FR00/01319

§ 371 (c)(1),
(2), (4) Date: Jan. 16, 2002

(87) PCT Pub. No.: WO00/69754

PCT Pub. Date: Nov. 23, 2000

(30) Foreign Application Priority Data

May 17, 1999 (FR) ..... 99 06195

(51) Int. Cl.[7] ..... B67D 5/42
(52) U.S. Cl. ..... 222/182; 222/321.7; 222/321.9
(58) Field of Search ..... 222/182, 321.7, 222/321.9

(56) References Cited

U.S. PATENT DOCUMENTS

| | | | | |
|---|---|---|---|---|
| 2,870,943 A | * | 1/1959 | Scoggin, Jr. | 222/321.9 |
| 3,149,761 A | | 9/1964 | Harris | |
| 3,185,349 A | | 5/1965 | Sagarin | |
| 3,306,497 A | * | 2/1967 | Kenney et al. | 222/321.9 |
| 3,462,045 A | * | 8/1969 | Markowitz | 222/182 |
| 3,690,519 A | * | 9/1972 | Wassilieff | 222/182 |
| 4,467,930 A | * | 8/1984 | Schnell et al. | 215/252 |
| 4,676,407 A | * | 6/1987 | Rideout | 222/182 |
| 5,388,727 A | * | 2/1995 | Jouillat | 222/105 |
| 5,509,580 A | * | 4/1996 | Glynn | 222/182 |
| 5,657,905 A | * | 8/1997 | Glynn | 222/182 |

FOREIGN PATENT DOCUMENTS

| | | |
|---|---|---|
| BE | 700 883 A | 1/1968 |
| DE | 20 02 416 A | 7/1970 |
| DE | 25 02 903 A | 8/1975 |
| FR | 1 557 484 A | 2/1969 |
| GB | 913 103 A | 12/1962 |

* cited by examiner

*Primary Examiner*—Kenneth Bomberg
(74) *Attorney, Agent, or Firm*—Sughrue Mion, PLLC

(57) ABSTRACT

A fluid dispenser comprising a dispensing member (1), such as a pump or a valve, a receptacle (2) provided with a neck (20), a metal fixing member (3) co-operating with said neck (20) to fix said dispensing member (1) in said neck (20), and a trim band (5) mounted to mask the dispensing member and the fixing member at least in part, said fluid dispenser being characterized in that the trim band (5) is mounted on a plastics ring (4) formed around the metal fixing member (3).

5 Claims, 1 Drawing Sheet

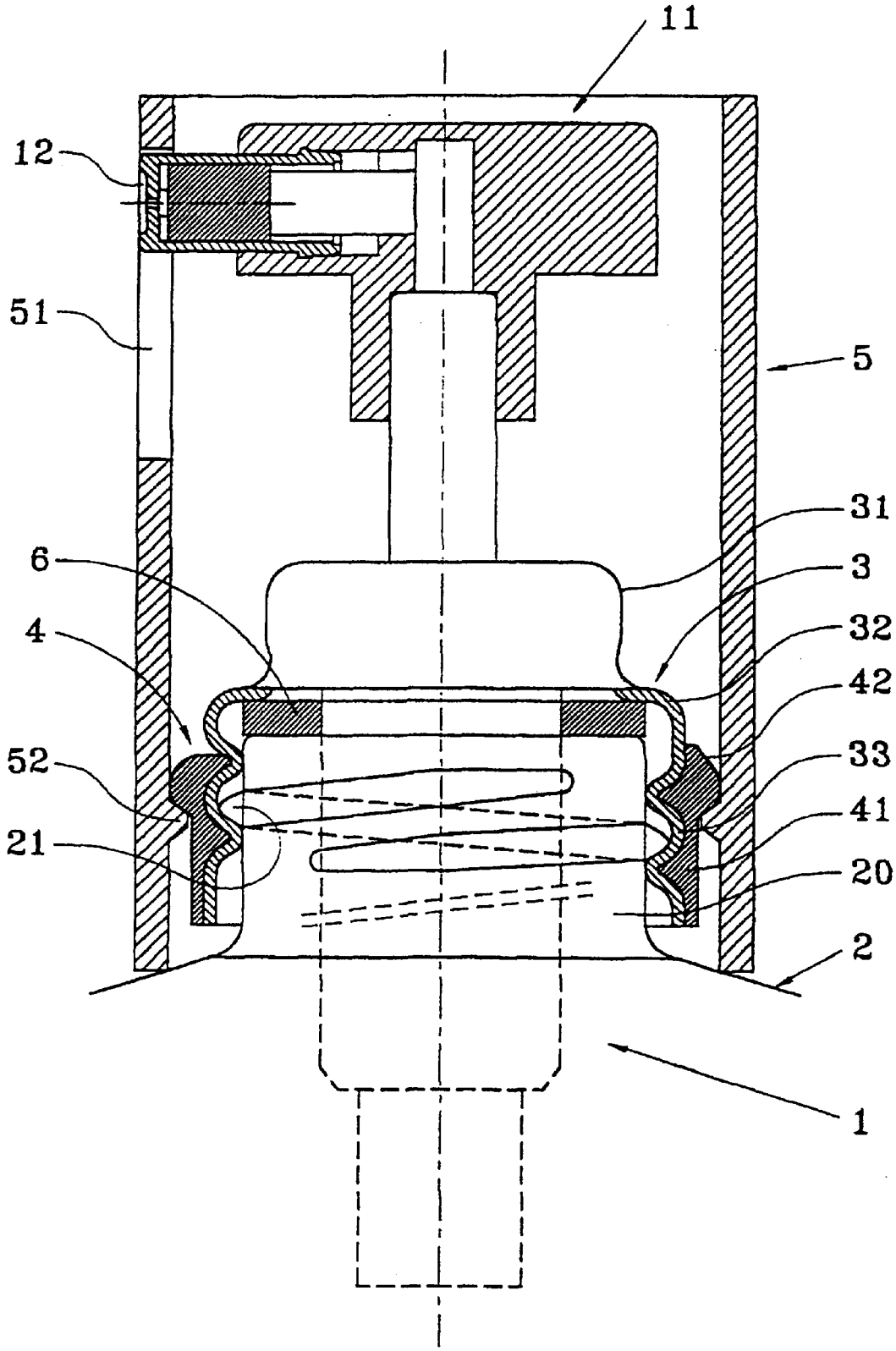
SOLE FIGURE

DISPENSER FITTED WITH AN OUTER FRAME

The invention relates to a fluid dispenser comprising a dispensing member, such as a pump or a valve, and a receptacle forming a neck on which the pump or the valve is mounted by means of a metal fixing member.

Document DE-20 02 416 describes an aerosol device comprising a metal can forming a neck in which a valve is mounted by means of a fixing ring. A cap is mounted on the aerosol device by co-operating with an intermediate ring mounted on the fixing ring.

In Document DE-25 02 903, the aerosol device described includes a valve actuating head which is fixed on an intermediate ring mounted on the fixing ring for fixing the valve.

In certain cases, the dispenser includes a trim band mounted to mask the pump or the valve and the fixing member, at least in part.

That type of dispenser is used in particular in the fields of perfumes or of cosmetics, for the purpose of dispensing creams or perfumes. The shape of the trim band can then be attractive in appearance and can be in harmony with the shape of the receptacle. Such a dispenser generally includes a pump which is fixed to the neck of the receptacle by means of a metal ring in which the pump is crimped. The ring is further provided with a threaded sleeve to performing the fixing by screwing onto the neck of the receptacle.

Since it is almost impossible to mount the trim band stably on such a metal ring, an additional ring mounted on the fixing ring is used in the prior art. Such an additional ring generally has a snap-fastening outside profile serving to co-operate with the inside of the trim band which can preferably be provided with a complementary snap-fastening profile.

It has been observed that mounting a trim band on such an additional ring that is itself mounted on the metal fixing ring does not offer sufficient stability, the trim band therefore being somewhat unstable or having play.

An object of the present invention is to remedy that drawback of the prior art by defining a fluid dispenser whose trim band is mounted in properly fixed and stable manner on a metal fixing ring.

To this end, the present invention makes provision for the trim band to be mounted on a plastics ring overmolded onto the metal fixing member. The problem of the lack of stability of the trim band that arises from the metal-to-metal contact between the metal fixing ring and the additional metal ring is solved by using an overmolded plastics ring which acts as an interface offering some degree of flexibility between the metal fixing ring and the trim band. By using this particular overmolding technique, the plastics ring is guaranteed to fit snugly on the outside shape of the fixing ring, so that it is impossible for there to be any play between the plastics ring and the fixing ring. Preferably, the fixing ring includes a threaded sleeve engaged with an outside thread formed on the neck of the receptacle, the plastics ring being formed on said threaded sleeve. And, when the fixing ring is screwed onto the neck of the receptacle, said fixing ring has a threaded sleeve that has an undulating outside peripheral surface which corresponds to the negative of the inside thread. The overmolded plastics ring then fits snugly on the profile of the undulating surface of the sleeve, thereby further increasing the adhesion with which the plastics ring adheres to the sleeve.

According to a characteristic of the invention, the plastics ring is provided with a snap-fastening profile which projects radially outwards. In addition, the trim band is provided with an inside snap-fastening profile which co-operates by snap-fastening with the profile of the plastics ring. Preferably, the profile of the band is engaged under the profile of the ring, the band coming into abutment via its bottom end against the receptacle.

Another feature of the invention is that the trim band may be provided with a window via which the fluid is dispensed, advantageously via a spray nozzle.

The invention is described more fully below with reference to the accompanying drawing, giving an embodiment of the invention by way of non-limiting example.

The sole FIGURE is a section view of a fluid dispenser of the invention.

The fluid dispenser shown in the sole FIGURE includes a receptacle 2 provided with a neck 20 having an outside thread 21. A pump or a valve 1 is mounted on the neck 20 by means of a fixing member 3 which, in this example, is in the form of a metal fixing ring. The fixing ring 3 is provided with a crimp-on housing 31 in which the body of the pump or of the valve 1 is received in a fixed mariner. Below the crimp-on housing 31, the fixing ring 3 forms a shoulder 32 serving to press a sealing gasket 6 against the top end of the neck 20. Below the shoulder 32, the fixing ring 3 forms a screw-on sleeve 33 with a thread serving to co-operate by screwing with the outside thread 21 of the neck 20. Thus, the pump or the valve 1 received in the crimp-on housing 31 can be fixed to the neck 20 by screwing the sleeve 33 onto the threaded neck 20 of the receptacle.

In the invention, the metal fixing ring 3 is provided with a plastics ring 4 which, in this example, is formed level with the screw-on sleeve 33. Preferably, the plastics ring 4 is formed on the sleeve 33 by an overmolding technique consisting in molding the plastics ring 4 directly over the metal fixing ring 3. Since the outside surface of the sleeve 33 has undulations corresponding to the inside thread for co-operating with the threaded neck 20 of the receptacle 2, the adhesion with which the ring 4 adheres to the sleeve 3 is further improved by means of the overmolding technique because the ring fits snugly on the profile of the undulating surface of the sleeve. The bond between the plastics ring and the fixing ring is thus guaranteed to be without any play.

The outside periphery of the plastics ring 4 is provided with a snap-fastening profile 42 which projects outwards.

In the invention, a trim band 5, which is in the form merely of a cylinder in this example, is mounted to mask, at least in part, the dispensing member 1 and the fixing ring as provided with its plastics ring. For fixing the trim band 5, a snap-fastening profile 52 is provided that projects inwardly and that co-operates with the corresponding snap-fastening profile 42 formed by the plastics ring 4. More precisely, the snap-fastening profile 52 of the trim band 5 comes into engagement under the snap-fastening profile 42 of the ring 4, with the bottom end of the trim band 5 coming into abutment against the receptacle 2. The trim band 5 can be made of a plastics material which guarantees excellent stability on the plastics ring 4 which, itself, is overmolded on the sleeve 33 of the metal fixing ring. Thus, the trim band 5 is mounted with excellent stability.

The trim band 5 may have any original or aesthetically-pleasing shape, and may, for example, be provided with a window 51 in which a spray nozzle of a pusher 11 mounted on an actuating rod of the pump or of the valve can be positioned. The trim band 5 is open at its top end, and it is then necessary merely to press on the pusher 11 to dispense a jet of sprayed fluid through the window 51.

What is claimed is:

1. A fluid dispenser comprising a dispensing member (1), a receptacle (2) provided with a neck (20), a metal fixing member (3) co-operating with said neck (20) to fix said dispensing member (1) in said neck (20), and a trim band (5) mounted to mask the dispensing member and the fixing member at least in part, the trim band (5) being mounted on a plastics ring (4) formed around an outside shape of the metal fixing member (3), said fluid dispenser being characterized in that the plastics ring (4) is overmolded onto the metal fixing member, the plastics ring fitting snugly on the outside shape of the fixing member so that there is no play between them; and wherein the fixing member (3) includes a threaded sleeve (33) engaged with an outside thread formed on the neck (20) of the receptacle, the plastics ring being formed on said threaded sleeve (33); and wherein the threaded sleeve (32) has an undulating outside peripheral surface, said ring fitting snugly on the profile of said undulating surface of the sleeve.

2. A fluid dispenser according to claim 1, in which the plastics ring (4) is provided with a snap-fastening profile (42) which projects radially outwards.

3. A fluid dispenser according to claim 2, in which the trim band is provided with an inside snap-fastening profile (52) which co-operates by snap-fastening with the profile (42) of the plastics ring (4).

4. A fluid dispenser according to claim 2, in which the profile (52) of the band (5) is engaged under the profile (42) of the ring (4), the band coming into abutment via its bottom end against the receptacle (1).

5. A fluid dispenser according to claim 1, in which the trim band is provided with a window (51) via which the fluid is dispensed, advantageously via a spray nozzle (12).

* * * * *